United States Patent [19]

Rausing

[11] 3,982,029

[45] Sept. 21, 1976

[54] PACKAGE INTENDED FOR PRESSURIZED CONTENTS

[75] Inventor: Gad A. Rausing, Lund, Sweden

[73] Assignee: Sobrefina SA, Fribourg, Sweden

[22] Filed: Oct. 10, 1973

[21] Appl. No.: 405,007

[30] Foreign Application Priority Data

Oct. 17, 1972 Switzerland ..... 15144/72

[52] U.S. Cl. ..... 426/106; 215/12 R; 229/14 B; 426/410

[51] Int. Cl.[2] ..... B65D 5/40; B65D 5/56; B65B 31/02

[58] Field of Search ..... 426/124, 106, 110, 118, 426/410, 411, 413, 392; 229/14 B, 14 BE; 215/1 C, 12 R; 220/69, 65, 63

[56] References Cited

UNITED STATES PATENTS

| | | | |
|---|---|---|---|
| 2,441,778 | 5/1948 | Traver | 229/14 BE |
| 3,147,903 | 9/1964 | Lipschutz et al. | 229/14 B |
| 3,240,327 | 3/1966 | Brina | 229/14 B X |
| 3,318,505 | 5/1967 | Garrison et al. | 229/14 B |
| 3,325,030 | 6/1967 | Rausing et al. | 215/1 C X |
| 3,352,472 | 11/1967 | Cummings et al. | 229/14 B |
| 3,469,760 | 9/1969 | Rausing et al. | 229/14 B |
| 3,529,647 | 9/1970 | Ignell | 229/14 B |
| 3,567,104 | 3/1971 | Arslanian | 229/14 B |
| 3,589,506 | 6/1971 | Ford et al. | 229/14 B X |
| 3,615,709 | 10/1971 | Ford et al. | 426/106 |
| 3,620,774 | 11/1971 | Ford et al. | 426/106 |

FOREIGN PATENTS OR APPLICATIONS

| | | | |
|---|---|---|---|
| 1,134,927 | 8/1962 | Germany | 229/7 R |
| 1,209,426 | 10/1970 | United Kingdom | 229/14 B |

*Primary Examiner*—Steven L. Weinstein
*Attorney, Agent, or Firm*—Pierce, Scheffler & Parker

[57] ABSTRACT

A package for pressurized material comprises an inner container of plastics and a shell of non-extensible material. The plastics inner container is in the form of a tube, and is sealed along two seals spaced from each other, the length of the seals is greater than the distance between them.

3 Claims, 3 Drawing Figures

PACKAGE INTENDED FOR PRESSURIZED CONTENTS

The present invention relates to a package intended for pressurized contents, comprising an inner container of plastic material and a shell of a non-extensible material, e.g. paper.

It is known that for the packaging of pressurized contents a plastic container can be used into which the contents are placed and which can be tightly sealed and which container is designed so that certain parts by virtue of their geometrical shape, e.g. dished or conical shape, are capable of absorbing stresses emanating from the contents whilst on the other hand other parts of the container, in particular a cylindrical portion between the end parts, are not capable without deformation to absorb the stresses emanating from the contents. This portion which is located between the end parts can then in a known manner be provided with an outer shell of a non-extensible material, which shell surrounds the parts of the inner container which require to be supported and which absorbs the forces which act upon the supported portion of the inner container.

The said inner container may be manufactured of a relatively rigid plastic, but it may also be manufactured of soft and flexible plastic tube, the ends of which are closed by means of heat sealing transversely to the longitudinal axis of the tube after the same has been filled with the intended contents. When the contents consist of beer or other liquid containing carbon dioxide under pressure it is naturally important that the plastic material should be so gas-tight that the carbon dioxide does not diffuse out or oxygen gas diffuses in through the walls of the container, and it can in certain cases be appropriate to manufacture the tube of a laminate, where at least one plastic layer included in the laminate has the required gas barrier properties.

In the manufacture of known packing containers of the above-mentioned type it was found difficult to achieve sufficient mechanical strength of the transverse seals of the tube which project outside the said outer shell or which are exposed in the opening of the said shell. Thus it was found that it is not sufficient to seal off the tube by a single transverse seal, since the gas pressure inside the tube is so great that such a single transverse seal can easily be broken at normal handling and transport of the packages. Instead it was found necessary to reinforce the transverse seals by separate, folded over strips of a stronger plastic material, which makes the manufacture of the package both more expensive and more complicated. These disadvantages are overcome in packages in accordance with the invention in that the transverse seams of the tube are not exposed at the openings of the outer shell, but are instead covered by the outer shell, whilst the parts of the tube which project outside or are exposed at the openings of the shell do not have any sealing seam.

Figure 1:
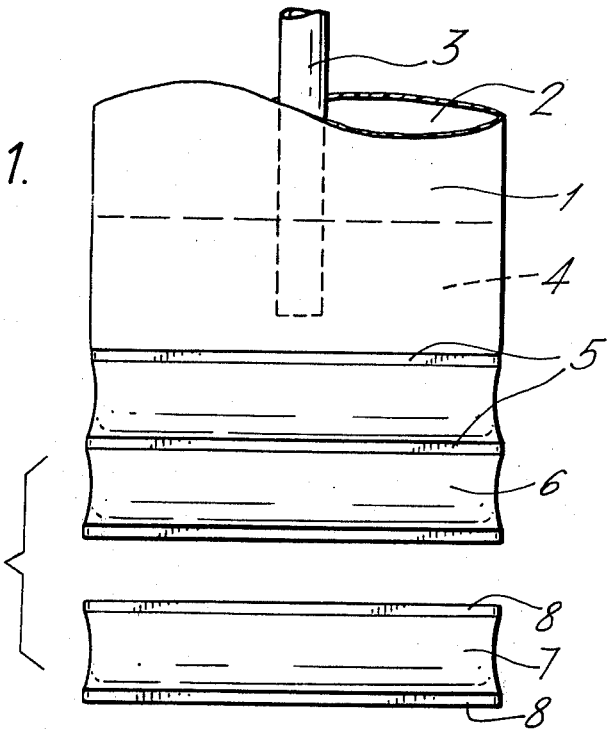
Figure 2:
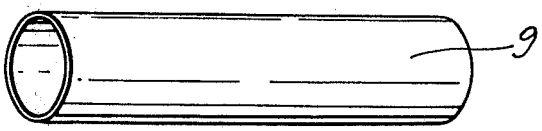
Figure 3:
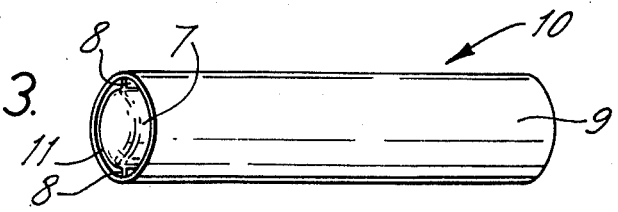

The invention will be described in the following with reference to the enclosed schematic drawing, in which FIG. 1 illustrates how a tube of plastic material is filled with contents and is sealed off to form filled portions of the tube, FIG. 2 shows a shell of non-extensible material, and FIG. 3 shows a package in accordance with the invention.

In FIG. 1 is shown how a seamless tube 1 of a plastic material, e.g. polyvinylchloride, polyethylene, polypropylene or the like, which tube is preferably laminated with a layer of a gastight material, e.g. polyvinylidene chloride, is filled with some contents 4 through a filling pipe 3. It is assumed that the contents 4 consist of beer, refreshing beverages or some similar substance containing carbon dioxide, and that the filling takes place at such a low temperature that the carbon dioxide is to a substantial part dissolved in the liquid. The tube 1 which is filled through its upper, open end 2 is sealed off by means of sealing elements not shown here along sealing zones 5, which are arranged at a right angle to the longitudinal axis of the tube. By the sealing off along the sealing zones 5 closed spaces 6 holding the contents are formed, and separate, cushion-like units 7 holding the contents are then separated from the tube 1 by severing them from the tube by means of cutting through the said sealing zones 5.

At the separation of the units 7 sealing fins 8 are formed along these, which in the example shown here have a length which appreciably exceeds the mutual distance between the sealing fins 8. Thus, the fin length may be from three to 10 times that of the mutual distance between the fins 8, 8.

In FIG. 2 is shown a shell 9 which can preferably be manufactured of paper or cardboard. This shell is intended to surround the units 7 separated from the tube 1, and the shell can be manufactured in advance as shown in FIG. 2, but it can also be manufactured in that a web or a sheet of paper is wound around the units 7 and that the edges of the web or the sheet are glued or pasted to one another to form the shell 9.

In FIG. 3 is shown the finished package 10, which thus consists of the shell 9 of a non-extensible material, e.g. paper, metal foil, cardboard or the like, which shell 9 can be provided with informative or advertising text. As can be seen from FIG. 3 the shell 9 surrounds the separated cushion-like units 7 shown in FIG. 1 holding the pressurized contents in such a manner that the sealing fins 8 of the separated unit 7 are wholly accomodated in the shell 9, whilst on the other hand the parts 11 of the units 7 exposed at the end of the shell 9 do not present any sealing seam.

The sealing seams or sealing fins 8 of the units 7 holding the contents thus receive mechanical support from the outer sleeve 9, which means that the forces emanating from the contents, which act upon the seals 8 are largely absorbed by the shell 9 and that the said seals 8 can take up the stresses occurring without special reinforcing measures having to be taken. The parts of the inner container 7, which project outside the shell 9 or which are exposed at its ends, do not present any sealing seam and can therefore through suitable dimensioning of the thickness of the plastic tube take the prevailing pressure emanating from the contents.

It was found that a package in accordance with the present invention is considerably cheaper to manufacture than other packages, which is due to the fact that an inner container of a relatively thin plastic material, which by itself cannot absorb the stresses emanating from the contents without becoming deformed, will be surrounded by an outer, mechanically rigid shell, and since the sealing seams do not have to be reinforced in separate working operations the package in accordance with the invention is moreover considerably simpler to manufacture.

I claim:

1. Package of pressurized fluid comprising at least one inner container of plastic material, a filling of pressurized fluent material within the inner container, an open-ended outer shell surrounding the inner container of a non-extensible material, wherein the inner container consists of a piece of a plastic film tube sealed off along two flat sealing seams arranged at a distance from one another transversely to the tube, the length of the sealing seams appreciably exceeding the distance between them, said sealing seams along their entire length being in contact with the inside of said shell in such a way that the sealing seams are mechanically supported by the shell in order to prevent the sealing seams from being broken by the pressure inside the inner container.

2. Package in accordance with claim 1, in which said sealing seams are arranged parallel to one another and are three to ten times as long as is the mutual distance between them.

3. Package in accordance with claim 1, in which any parts of the inner container which are exposed from the outer shell do not present any sealing seams.

* * * * *